United States Patent [19]

Mattei

[11] Patent Number: 4,648,409

[45] Date of Patent: Mar. 10, 1987

[54] PAPER WEB FEED DEVICE IN A CIGARETTE PRODUCTION MACHINE

[75] Inventor: Riccardo Mattei, Bologna, Italy

[73] Assignee: G.D Societa per Azioni, Bologna, Italy

[21] Appl. No.: 813,680

[22] Filed: Dec. 26, 1985

[30] Foreign Application Priority Data

Jan. 16, 1985 [IT] Italy ..... 3307 A/85

[51] Int. Cl.[4] ..... A24C 5/14; A24C 5/08

[52] U.S. Cl. ..... 131/60; 131/280; 131/84.1; 131/94; 493/16; 83/80; 83/98; 83/102

[58] Field of Search ..... 131/284, 84.1, 280, 131/843, 60, 84.4, 94; 493/16, 461, 12, 40; 226/109, 110; 83/98–100, 102, 80

[56] References Cited

U.S. PATENT DOCUMENTS 4,336,812 6/1982 Seragnol ..... 131/84.1
4,548,216 10/1985 Ahern ..... 131/94
4,598,719 7/1986 Mattei et al. ..... 131/84.1

*Primary Examiner*—V. Millin
*Assistant Examiner*—H. Macey
*Attorney, Agent, or Firm*—Marshall, O'Toole, Gerstein, Murray & Bicknell

[57] ABSTRACT

In a cigarette production machine, a device for feeding at least one paper web along one or other of two paths, the first of which extends through a station for loading a continuous stream of shredded tobacco onto said web, and the second of which is a discard path; that portion of the web extending along said second path being cut and removed by a selectively operable removal device.

7 Claims, 4 Drawing Figures

PAPER WEB FEED DEVICE IN A CIGARETTE PRODUCTION MACHINE

BACKGROUND OF THE INVENTION

This invention relates to a paper web feed device in a cigarette production machine.

In cigarette production machines, it is known to form the outer cigarette covering from one or more paper webs fed by means of a continuous feed device through a loading station, in which a continuous stream of shredded tobacco is fed onto each web.

In the said known feed devices, each paper web is advanced through said loading station supported by a conveyor, immediately upstream of which there is disposed a suction roller arranged to give the web the necessary forward thrust for unwinding the web from a reel and for passing it, before reaching said conveyor, through a series of devices comprising inter alia a printing unit which prints inscriptions on the web.

The printing units used in production machines normally suffer from starting difficulties in the sense that when production is resumed after each stoppage of the production machine, the print is defective for a time period which is certainly of limited duration but is such as to result in the production of some thousands of defective cigarettes, which have to be discarded and then destroyed in order to recover the tobacco used in them.

SUMMARY OF THE INVENTION

The object of the present invention is to provide a paper web feed device which, on each resumption of production, enables that portion of the paper web containing defective print to be directly eliminated, so as to prevent the formation of defective cigarettes and avoid the cost of recovering their tobacco.

Said object is attained according to the present invention by a paper web feed device in a cigarette production machine, comprising a suction roller for advancing at least one paper web along a first path, a loading station disposed along said first path downstream of said suction roller in order to feed a continuous stream of shredded tobacco onto said web, and a conveyor disposed along said first path for guiding said web through said loading station, characterised by further comprising selectively operable deviator means for separating said web from a portion of the periphery of said suction roller and deviating it along a second path, and removal means cooperating selectively with said suction roller in order to detach and remove the portion of said web fed along said second path.

BRIEF DESCRIPTION OF THE DRAWINGS

The invention is described hereinafter with reference to the accompanying drawings, which illustrate a non-limiting embodiment thereof, and in which.

DETAILED DESCRIPTION OF THE INVENTION

Figure 1:
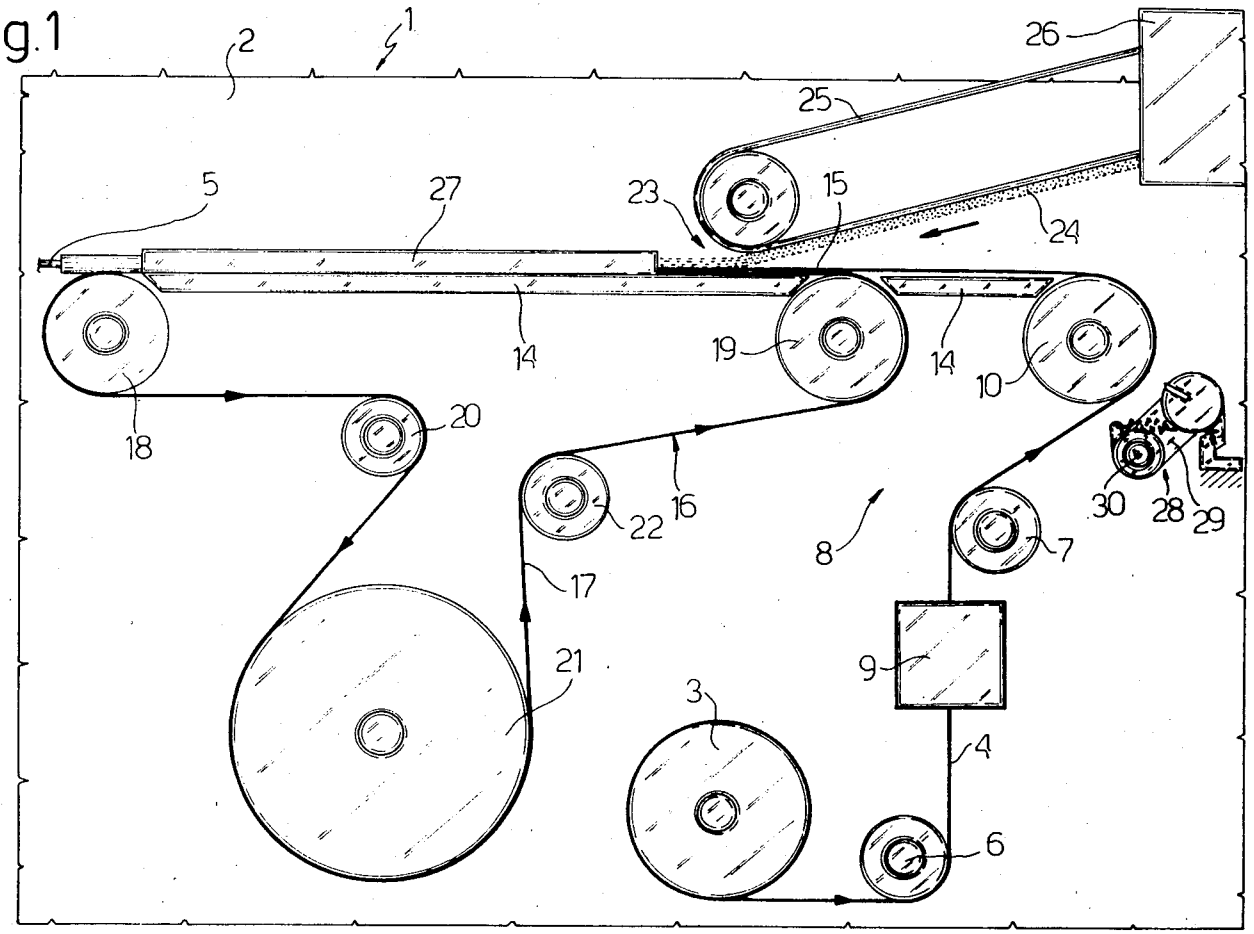
FIG. 1 is a diagrammatic illustration, with parts removed for clarity, of a production machine provided with a feed device constructed in accordance with the present invention.

FIG. 1 shows a cigarette production machine, indicated overall by 1 and comprising a base 2, on which a reel 3 is rotatably mounted.

A paper web 4 for forming the outer covering of a continuous cigarette rod 5 is unwound from the reel 3.

Starting from the reel 3, the web 4 unwinds in contact with two deviation rollers 6 and 7, and by means of a feed device indicated overall by 8 and disposed immediately downstream of the roller 7 is fed through a printing unit 9 disposed between the rollers 6 and 7.

The device 8 comprises a motorised suction roller 10, which is supported by the base 2 and rotates anticlockwise about its axis.

Figure 2:
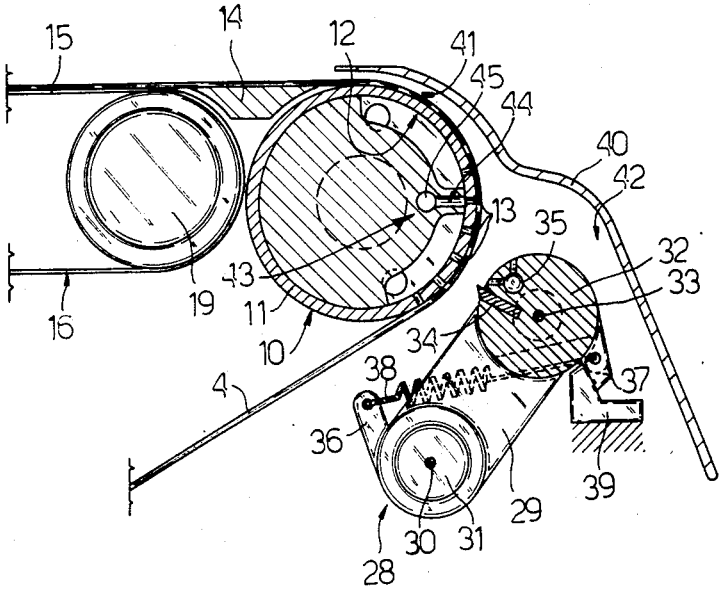
FIGS. 2, 3 and 4 are diagrammatic illustrations to an enlarged scale of the feed device of FIG. 1 in three successive operating positions.
Figure 3:
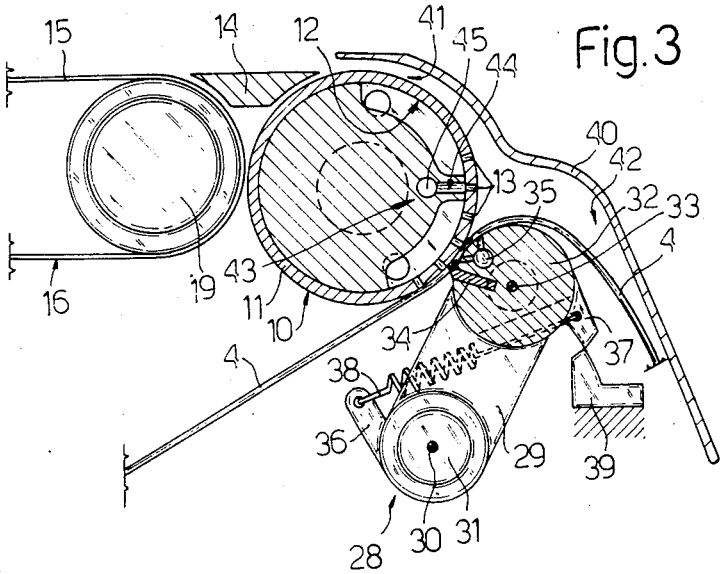
Figure 4:
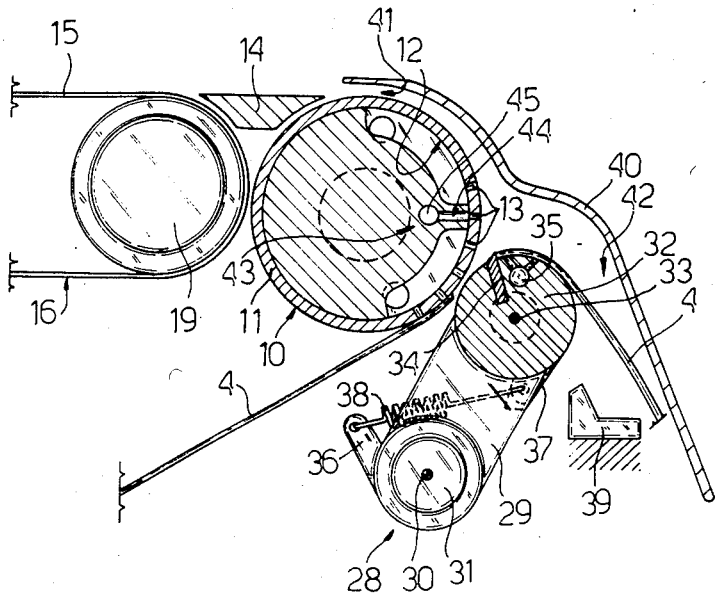

As shown in FIGS. 2 to 4, the roller 10 has a perforated rotatable outer shell 11, which defines an inner chamber 12 communicating with air suction conduits 13.

The roller 10 is disposed at the inlet end of a forming bench 14 for the rod 5, this bench being supported by the base 2 in a substantially horizontal position and supporting the upper branch 15 of an endless conveyor 16 forming part of the device 8 and comprising a lower branch 17 passing about two end rollers 18 and 19 and about three intermediate rollers 20, 21 and 22, of which the roller 21 is a drive roller.

The upper branch 15 of the conveyor 16 is arranged to guide the web 4 through a loading station 33, in which a continuous stream or layer 24 of shredded tobacco is fed onto the web 4 by a conveyor 25 which emerges from a tobacco feed device 26. The branch 15 is also arranged to guide the web 4 through a bar 27, along which the web 4 is folded transversely about the layer 24 to form the rod 5.

As shown in particular in FIGS. 2 to 4, the device 8 further comprises a removal device 28 comprising a lever 29 pivoted about a first axis 30 parallel to the axis of the suction roller 10 and arranged to rock about said axis 30 under the thrust of actuator means comprising an actuator device 31 coaxial to the axis 30.

Connected to the free end of the lever 29 there is a support member constituted by a support roller 32 mounted idly on the lever 29 so as to rotate relative to this latter about a second axis 33 parallel to the axis 30. The roller is a support roller for a knife 34 extending radially outwards from the roller 32 substantially towards the roller 10, and for suction means comprising a suction unit 35 opening into the outer surface of the roller 32 in a position adjacent to the knife 34.

From opposite ends of the lever 29 there extend two appendices 36 and 37, the first of which is rigidly connected to the lever 29 and extends from a point on this latter close to the axis 30 towards the periphery of the suction roller 10, and the second of which is rigid with the roller 32 and extends outwards from a point on the outer periphery of the roller 32 disposed in a position substantially opposite the knife 34. The free ends of the appendices 36 and 37 are connected together by an actuator means of elastic type constituted by a spring 38, which operates under tension and extends transversely to the axis of the lever 29 in order to cause the roller 32 to undergo a clockwise rotation about the axis 33. The action of the spring 38 is opposed by stop means comprising a stop element 39 normally engaged slidably by the appendix 37.

The device 8 also comprises a guide wall extending above part of the roller 10 and above the removal device 28 to define a first channel 41 extending about the roller 10 towards the loading station 23, and a second channel 42 extending about the roller 32 towards the discarding station, not shown, for the web 4.

The device 8 finally comprises a deviator device 43 disposed in a fixed position within the chamber 12 of the roller 10 and comprising compressed air feed means constituted by the output duct 44 of a compressed air feed circuit 45, this duct being directed radially towards the shell 11 and substantially towards the roller 32, and communicating with the outside through the ducts 13 which become successively aligned with said duct 44 during the rotation of said shell 11.

In use, on starting the production machine 1, the web 4 unwinds normally along a first path defined by the periphery of the rollers 6, 7 and 10, and is disposed with its end on the bench 14. When the suction roller 10 is started, the deviator device 43 becomes simultaneously activated, with the emission through the duct 44 of a blast of compressed air which separates the web 4 from a part of the periphery of the shell 11 and deviates it along a second path extending along the channel 42 and about the removal device 28. When the machine 1 is operating normally and the operator sees that the inscription printed on the web 4 by the printing unit 9 is correct and perfectly legible, he operates the actuator device 31, which causes the lever 29 to rotate anticlockwise from its normal rest position shown in FIG. 2 in which the roller 32 is kept separated from the roller 10 by the engagement of the appendix 37 with the stop element 39 under the thrust of the spring 38.

The operation of the actuator device 31 causes the appendix 37 to slide along the stop element 39, which keeps the roller 32 in an angularly fixed position relative to the lever 29 until the cutting position shown in FIG. 3 is reached, in which the knife 34 comes into contact with the web 4 unwinding along the roller 10. The attaining of the said cutting position, in which the web 4 is cut transversely to its axis, leads to deactivation of the deviator device 43, disengagement of the appendix 37 from the stop element 39, and activation of the suction device 35. Consequently, the knife 34 cuts the web and snaps upwards simultaneously by the effect of the clockwise rotation impressed on the roller 32 by the spring 38.

The web 4 which remains embracing the shell 11 is fed upwards by it along said first path extending along the bench 14 and through the loading station 23, whereas that portion of web 4 cut off by the knife 34 is retained by the suction device 35 in contact with the periphery of the roller 32. For this purpose, the suction device 35 is suitably disposed along the periphery of the roller 32 downstream of the knife 34 in the direction of rotation of the roller 32.

At a later stage, the operator manually returns the removal device 28 to its rest position of FIG. 2.

The use of the described feed device 8 leads to numerous advantages, of which the most important is that it prevents a defective web portion from reaching the loading station 23. During the entire time in which the web 4 is deviated along the channel 42, the tobacco fed by the conveyor 25 falls directly onto the conveyor 16, and is fed by this latter to a discharge container, not shown. In this manner, it is not necessary to destroy defective cigarettes, and the discarded tobacco can be immediately returned to the cycle.

The feed device 8 also has the advantage of forming a perfect cut at the front end of the web 4, so reducing substantially to zero the possibility of said end becoming folded and sticking during its advancement along the bench 14. This advantage is particularly apparent where the feed device 8 is used, with obvious modifications, on a double rod machine such as that described in U.S. Pat. No. 4,336,813 of the present applicant, in which two webs 4 are fed.

I claim:

1. A paper web feed device in a cigarette production machine, comprising a suction roller (10) for advancing at least one paper web (4) along a first path, a loading station (23) disposed along said first path downstream of said suction roller (10) in order to feed a continuous stream (24) of shredded tobacco onto said web (4), and a conveyor (16) disposed along said first path for guiding said web (4) through said loading station 23, characterised by further comprising selectively operable deviator means (43) for separating said web (4) from a portion of the periphery of said suction roller (10) and deviating it along a second path, and removal means (28) cooperating selectively with said suction roller (10) in order to detach and remove the portion of said web (4) fed along said second path.

2. A device as claimed in claim 1, characterised in that said deviator means (43) are pneumatic means.

3. A device as claimed in claim 2, characterised in that said pneumatic means comprise compressed air feed means (44, 45) mounted on said suction roller (10) and directed radially towards a point on the outer periphery of said suction roller (10); said point constituting the beginning of said second path.

4. A device as claimed in claim 1, characterised in that said removal means (28) comprise knife means (34) disposed external to said suction roller (10); selectively operable suction means (35) disposed in a position adjacent to said knife means (34); first actuator means (31) for moving said knife means (34) from and towards a cutting point on the periphery of said suction roller (10); and second actuator means (38) for moving said suction means (35) from and towards said cutting point along said second path.

5. A device as claimed in claim 4, characterised in that said removal means (28) comprise a lever (29) pivoted about a first axis (30) parallel to the axis of rotation of said suction roller (10), said first actuator means (31) cooperating with said lever (29) in order to subject it to a rocking movement about said first axis (30); and a support member (32) mounted on said lever (29) so as to rotate relative to this latter about a second axis (33) parallel to said first axis (30) under the trust of said second actuator means (38), said support member (32) supporting said knife means (34) and said means (35).

6. A device as claimed in claim 5, characterised in that said second actuator means (38) are elastic means; stop means (39) cooperating with said support member (32) to prevent it rotating about said second axis (33) under the thrust of said elastic means until said knife means (35) have reached said cutting point under the thrust of said first actuator means (31).

7. A device as claimed in claim 6, characterised in that said support member comprises a support roller (32) rotatable under the thrust of said elastic means (38) about said second axis (33) in the opposite direction to the direction of rotation of said suction roller (10); said stop means comprising a stop element (39) disposed in a fixed position external to said support roller (32), and an appendix (37) extending outwards from said support roller (32) and slidably cooperating with said fixed stop element (39) during part of the rocking movement imposed on said support roller (32) about said first axis (30) by said first actuator means.

* * * * *